US008816809B2

(12) United States Patent
Kosaka et al.

(10) Patent No.: US 8,816,809 B2
(45) Date of Patent: Aug. 26, 2014

(54) REACTOR

(75) Inventors: Kazuhiro Kosaka, Kariya (JP); Ryota Tanabe, Nagoya (JP); Souichi Yoshinaga, Nagoya (JP); Masahiko Yamashita, Anjo (JP); Seigo Satou, Anjo (JP); Mitsutoshi Kameda, Shinshiro (JP); Tsugio Takeda, Sendai (JP)

(73) Assignees: Denso Corporation, Kariya (JP); Nec Tokin Corporation, Sendai (JP)

( * ) Notice: Subject to any disclaimer, the term of this patent is extended or adjusted under 35 U.S.C. 154(b) by 28 days.

(21) Appl. No.: 13/560,106

(22) Filed: Jul. 27, 2012

(65) Prior Publication Data

US 2013/0027163 A1 Jan. 31, 2013

(30) Foreign Application Priority Data

Jul. 28, 2011 (JP) ..... 2011-165755

(51) Int. Cl.
*H01F 27/02* (2006.01)
*H01F 17/04* (2006.01)

(52) U.S. Cl.
USPC ..... 336/90; 336/82; 336/83; 336/92; 336/96; 336/221

(58) Field of Classification Search
USPC ..... 336/82, 83, 90, 92, 96, 221, 233
See application file for complete search history.

(56) References Cited

U.S. PATENT DOCUMENTS

2010/0123541 A1* 5/2010 Saka et al. ..... 336/233

FOREIGN PATENT DOCUMENTS

| | | | |
|---|---|---|---|
| JP | 2010118503 A | * | 5/2010 |
| JP | 2010-199257 | | 9/2010 |
| JP | 2010-212632 | | 9/2010 |

* cited by examiner

*Primary Examiner* — Tsz Chan
(74) *Attorney, Agent, or Firm* — Nixon & Vanderhye PC

(57) ABSTRACT

A reactor is disclosed. The reactor is comprised of a housing, a solenoid coil, a center columnar member, and a core. The center columnar member provides first surfaces contacting with sandwich portions of the housing, and the core is comprised of resin including magnetic powder. The coil and the center columnar member are fixed in the core. A surface roughness (Rz2) of a second surface which contacts to the core is larger than a surface roughness (Rz1) of the first surfaces. The center columnar member further provides a basis surface of which roughness (Rz3) is smaller than the Rz2 and larger than the Rz1.

10 Claims, 7 Drawing Sheets

REACTOR

CROSS-REFERENCE TO RELATED APPLICATION

This application is based on and claims the benefit of priority from earlier Japanese Patent Application No. 2011-165755 filed Jul. 28, 2011, the description of which is incorporated herein by reference.

BACKGROUND

1. Technical Field of the Invention

The present invention relates to a reactor available for a power converter or the like.

2. Related Art

As a reactor for vehicles or a power converter like a DC-DC convertor, various types of structure are known, for example as described in Japanese Published Patent Application (JPA) 2010-199257. Afore mentioned reactor provides both a solenoid coil which generates a magnetic field by passing electricity through it and a core which consists of a non-conductive epoxy resin in which magnetic powder is included, wherein the coil is embedded within the core.

Especially in the reactor, a columnar member is disposed in a center of the core for improving radiation of heat generated by the coil and the core when electricity is passing through the coil.

In the reactor, the columnar center member is formed for example by die casting. However, mold lubricant such as silicon applied on the surface of a mold often remains behind on a surface of the columnar center member formed by the die casting.

Therefore in a case that the columnar center member is embedded in the core, adhesion between the columnar center member and the core is often insufficient since the congeniality between the mold lubricant such as silicone and non-conductive resin such as epoxy resin for core is insufficient.

If the adhesion between the columnar center member and the core is insufficient, it is feared that the efficiency of the radiating of heat toward the columnar center member from the core may become lowered.

Still more, in a reactor a large force of repulsion is generated between adjoining conductive wirings during operation. The coil may vibrate since the force of repulsion changes with the current flowing in the coil. This vibration travels to the core and the columnar center member so that the entire reactor vibrates.

Accordingly if the adhesion of the columnar center member to the core is not sufficient, there is a risk that the reactor's vibration may become larger caused by lowering of stiffness of the entire reactor. It is unacceptable.

Then, in the light of conditions set forth above, it is needed to provide a reactor such that the vibration of the entire reactor can be lowered and the efficiency of radiating heat generated by the coil and the core can be improved.

SUMMARY

A reactor is presented. The reactor is comprised of a housing, a solenoid coil, a center columnar member and a core. The center columnar member provides first surfaces contacting with sandwich portions of the housing, and the core is comprised of resin in which magnetic powder is included. The coil and the center columnar member are fixed in the core. A surface roughness (Rz2) of a second surface contacting with the core is larger than a surface roughness (Rz1) of the first surfaces. The center columnar member further provides a basis surface of which roughness (Rz3) is smaller than the Rz2 and larger than the Rz1.

DETAILED DESCRIPTION OF THE PREFERRED EMBODIMENTS

Figure 1:
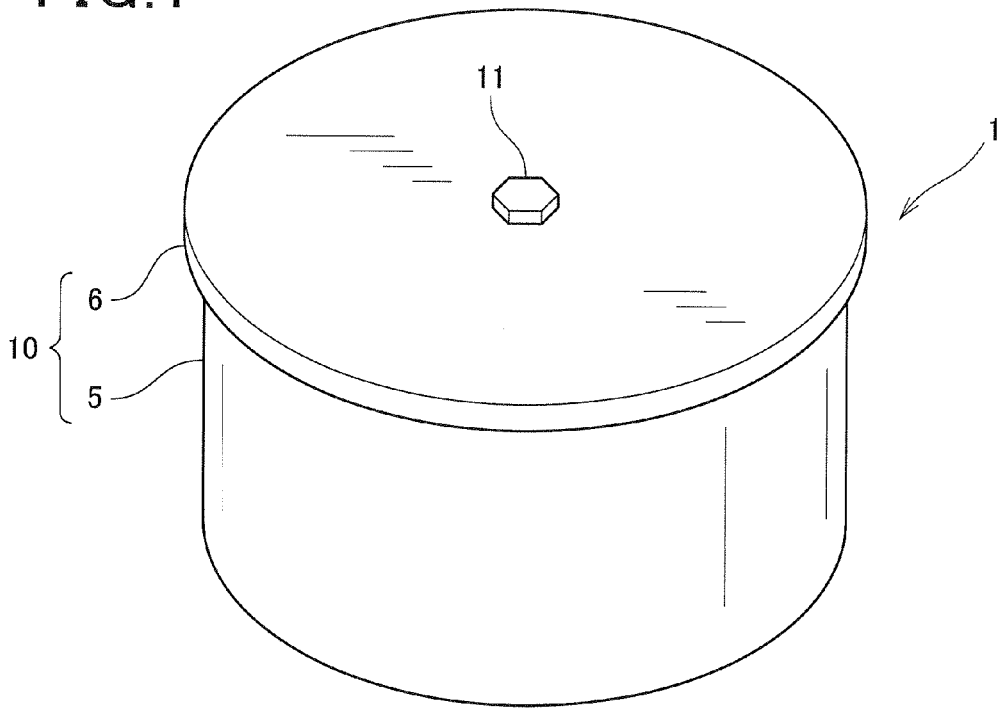
FIG. 1 shows an outer view of a reactor as an exemplary embodiment.

An exemplary embodiment of the present invention will be explained with reference to drawings. FIG. 1 shows an outer view of the reactor 1. The reactor 1 is covered with a nearly columnar housing 10. The housing 10 comprised of a cylindrical case 5 of which the upper portion is opened and lid 6. The lid 6 is screwed onto the case 5 by bolt 11.

Figure 2:
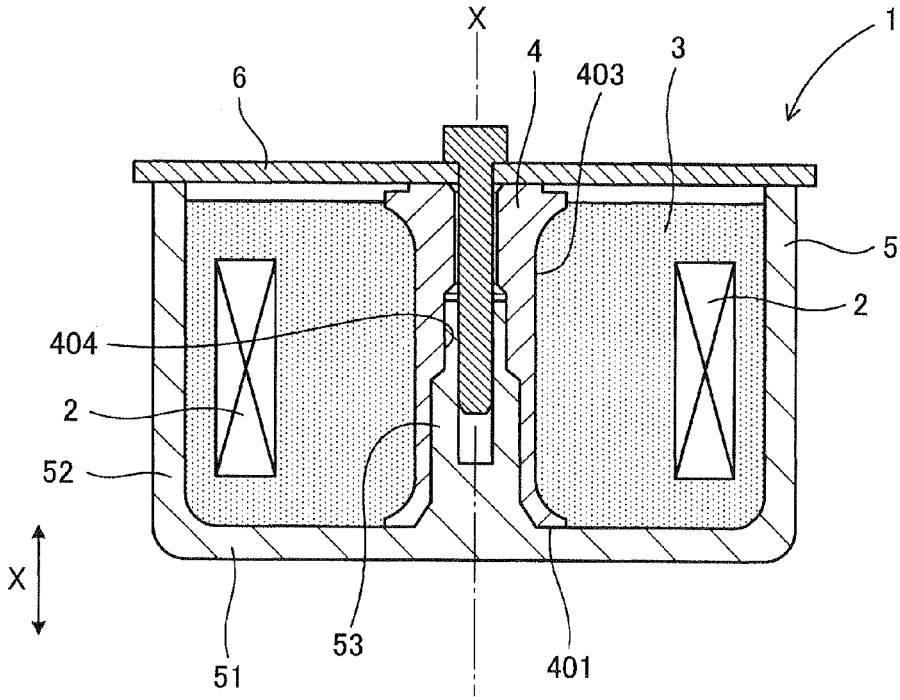
FIG. 2 shows a cross section of the reactor as an exemplary embodiment.

FIG. 2 shows a cross section of the reactor 1 as an exemplary embodiment. The reactor 1 is available, for example, for a power converter like a DC-DC converter used in vehicles. The reactor 1 is comprised of a solenoid coil 2 which generates a magnetic field when passing an electric current through it, a core 3 which forms a magnetic path for magnetic flux generated by the coil 2 and a center columnar member 4 for radiation of heat generated at the coil 2 and core 3 by conducting it away externally. These components are accommodated in the case 5.

The coil 2 consists of a solenoid coil (not shown in detail). The core 3 consists of epoxy resin in which iron powder is included. The iron powder is well-known magnetic powder and epoxy resin is insulating one. The coil 2 is entirely embedded within the core 3.

The case 5 has a bottom 51 which is flat with rounded edges, and a cylindrical side portion 52. A pillar 53 is formed at the center of the bottom 51 of the case 5 outward inside the case 5 along the center axis X. A hole 531 is formed within the pillar 53 (see FIG. 10), that is, the pillar 53 is hollow along its center axis X. A screw tap for bolt 11 is formed at the surface of the inner hole 531 of the pillar 53 (not shown in detail).

The case 5 consists of the bottom 51, the side portion 52 and the pillar 53 is composed of aluminum alloy and integrally formed by die-casting.

Figure 3:
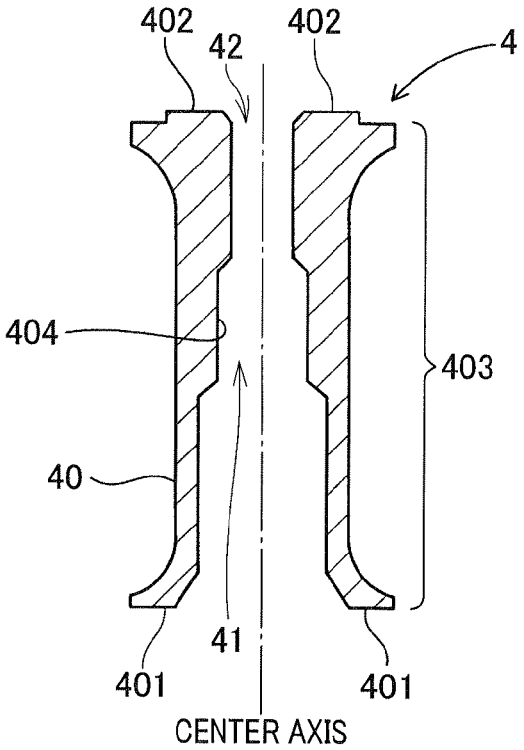
FIG. 3 shows a cross section of a center columnar member.
Figure 4:
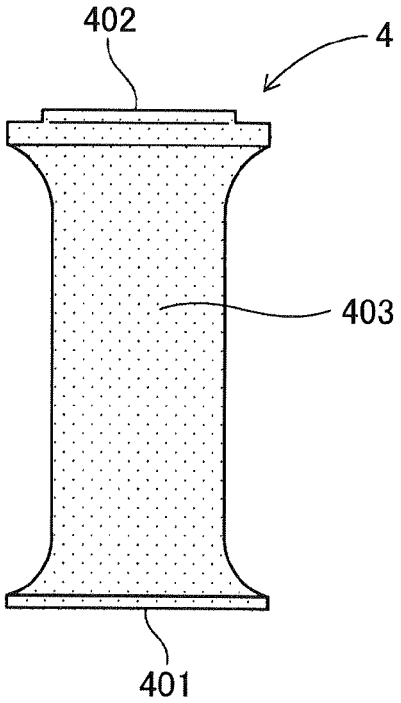
FIG. 4 shows a front view of the center columnar member.
Figure 5:
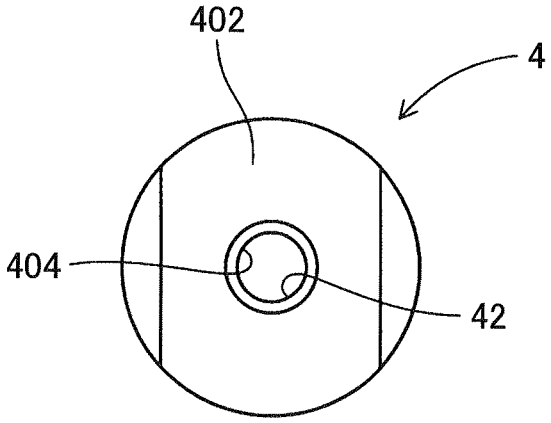
FIG. 5 shows a top view of the center columnar member.
Figure 6:
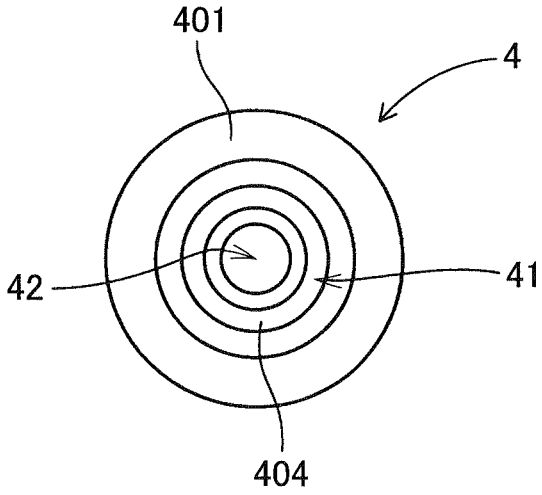
FIG. 6 shows a bottom view of the center columnar member.

Next, FIG. 3 shows a cross section of a center columnar member 4. FIG. 4 shows a front view of the center columnar member 4. FIG. 5 shows a top view of the center columnar member 4. FIG. 6 shows a bottom view of the center columnar member 4. As shown in FIG. 3, a fitting hole 41 is formed within the lower side of the center columnar member 4 for fitting onto the pillar 53 of the case 5. Still more, a through hole 42 is formed within the upper side of the center columnar member 4 for letting the bolt 11 through within it. The fitting hole 41 and the through hole 42 are coupled each other along a center axis of the member 4, i.e., the center columnar member 4 is hollow along its center axis.

As shown in FIG. 3 and FIG. 4, flat surfaces 401 and 402 are respectively formed by machining at the both upper and lower side of the center columnar member 4. More specifically, one of the flat surfaces 401 is formed at the bottom portion of the member 4 for abutting the bottom 51 of the case 5. Another flat surface 402 is formed at the top portion of the member 4 for abutting the lid 6. The surfaces 401 and 402 are defined as "first surfaces" in the Claim of this patent application. The flat surfaces 401 and 402 are formed in order that the center columnar member 4 can be fixed to the housing 10 caused by being sandwiched by both the case 5 and the lid 6. As shown in FIG. 2, the center columnar member 4 and the core 3 are installed in the case 5 at the state where flat surfaces 401 and 402 are exposed outside the core 3 and are fitted onto the pillar 53.

The center columnar member 4 is composed of aluminum alloy and formed by die-casting. Shot blasting is performed on a core contact surface 403 of the center columnar member 4. The core contact surface 403 directly contacts with the core 3, i.e. resin. The core contact surface 403 is defined as "the second surface" in the Claim of this patent application.

The inner surface 404 of the center columnar member 5 remains as it was after die-casting". Neither shot blasting nor machining are performed at all on an inner surface 404 of the center columnar member 4. A surface roughness (Rz2) of the inner surface 404 is smaller than a surface roughness (Rz3) of the core contact to surface 403 and larger than a surface roughness (Rz1) of the flat surface 401 and 402.

For example, the surface roughness (Rz2) of the core contact surface 403 may be 16 μm or more, the surface roughness (Rz1) of the flat surface 401 and 402 may be 6.3 μm or less and the surface roughness (Rz3) of the inner surface 404 may be formed at 12.5 μm. The inner surface 404 of the columnar member 4 is defined as "a basis surface" in the Claim of this patent application.

Next, the manufacturing method of the reactor 1 of the exemplary embodiment will be disclosed below. In the manufacturing of the reactor 1, the center columnar member 4 is made by die-casting. Next, the core contact surface 403 on the outer surface of the columnar member 4 is shot blasted and machining is carried out to the both upper side 402 and lower side of the member 4. Thereby the flat surfaces 401 and 402 are formed. Neither shot blasting nor machining is carried out at all on the inner surface 404 of the center columnar member 4.

Next, the shot blasting of the core contact surface 403 will be explained. Firstly the columnar member 4 is set on a turn table. Next, a shot blasting medium is sprayed onto the core contact surface 403 using a flexible nozzle while the table rotates. After that, fine particles are removed from the columnar member 4 by air spray.

As the afore-mentioned medium, abrasive corundum of hardness (Hv) from 2100 to 2300 and of grain diameter from 180 μm to 200 μm is used. Further as the working conditions, one can perform the process as follows. For example, the rotating speed of the rotating table is 36 rpm, the number of nozzles is three, rise and fall vibration frequency of the nozzle is 50 Hz, spray pressure is 0.3 MPa and spray period is 15 sec.

Figure 7:
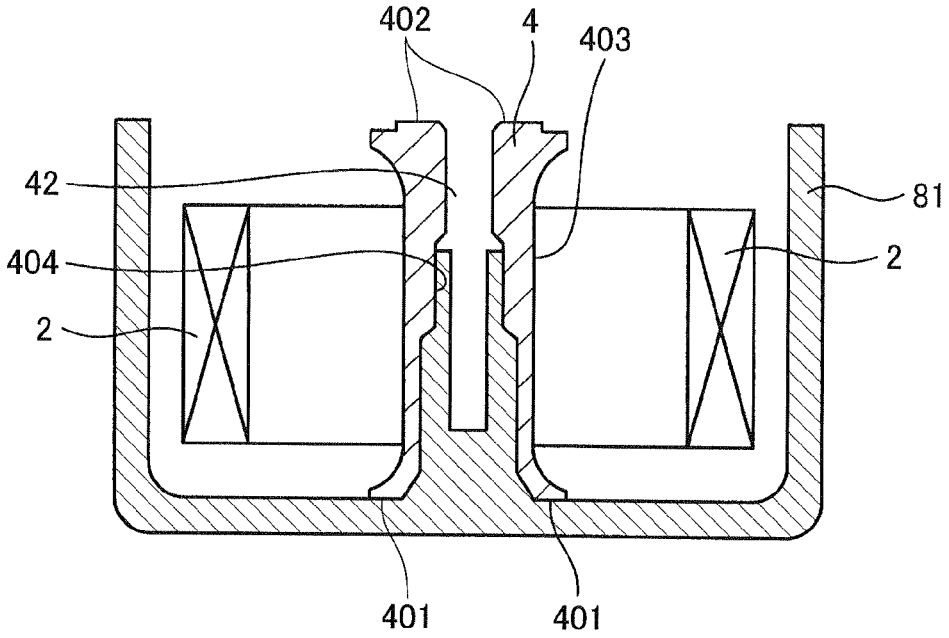
FIG. 7 shows a position relationship between a coil and the center columnar member disposed in a mold for formation of the core.
Figure 8:
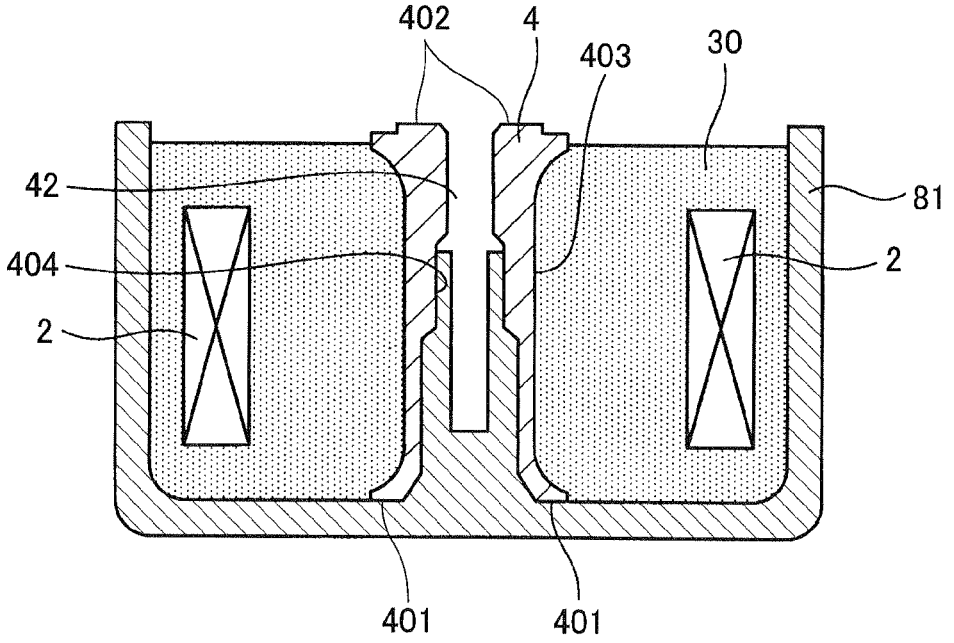
FIG. 8 shows a state where resin has been caulked in a mold for formation of the core.
Figure 9:
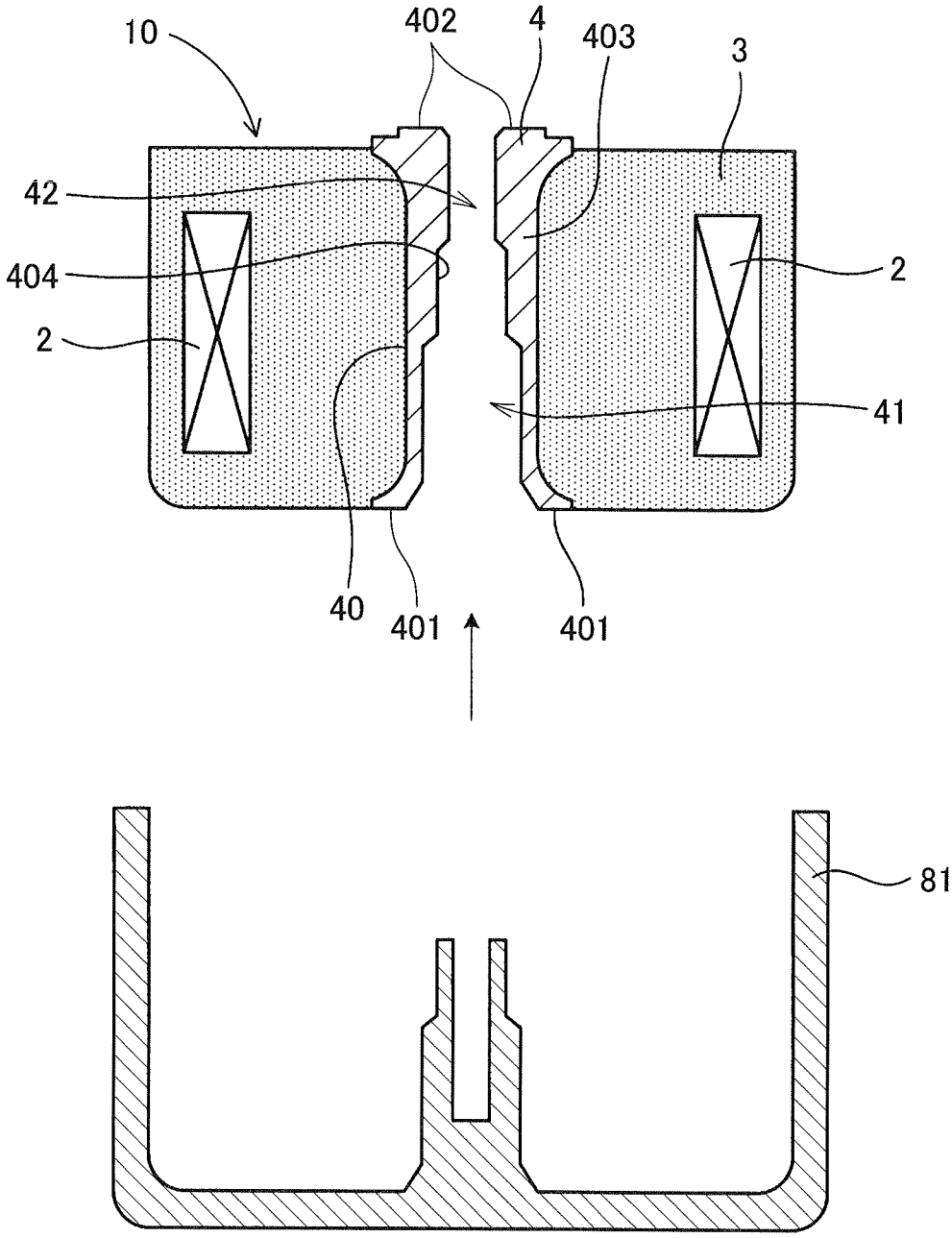
FIG. 9 shows a state where an intermediate product has been extracted from the mold for formation of the core.

Next, as shown in FIG. 7, the center columnar member 4 is fixed into a core forming die 81 of which the form is same as the case 5 and then disposes the solenoid coil 2 also into the core forming die 81. Next, as shown in FIG. 8, sol state resin 30 including magnetic powder is filled into the core forming die 81. At this time, the coil 2 is entirely embedded into the sol state resin 30. The resin 30 is then heat-treated. By heat-treatment, a short time later, sol state resin 30 will harden and then formation of the core 3 is completed. Next, as shown in FIG. 9, an intermediate product 12 is taken out of the core forming die 81. The intermediate product 12 includes the core 3 and the center columnar member 4. The core 3 includes the coil 2 in it.

Figure 10:
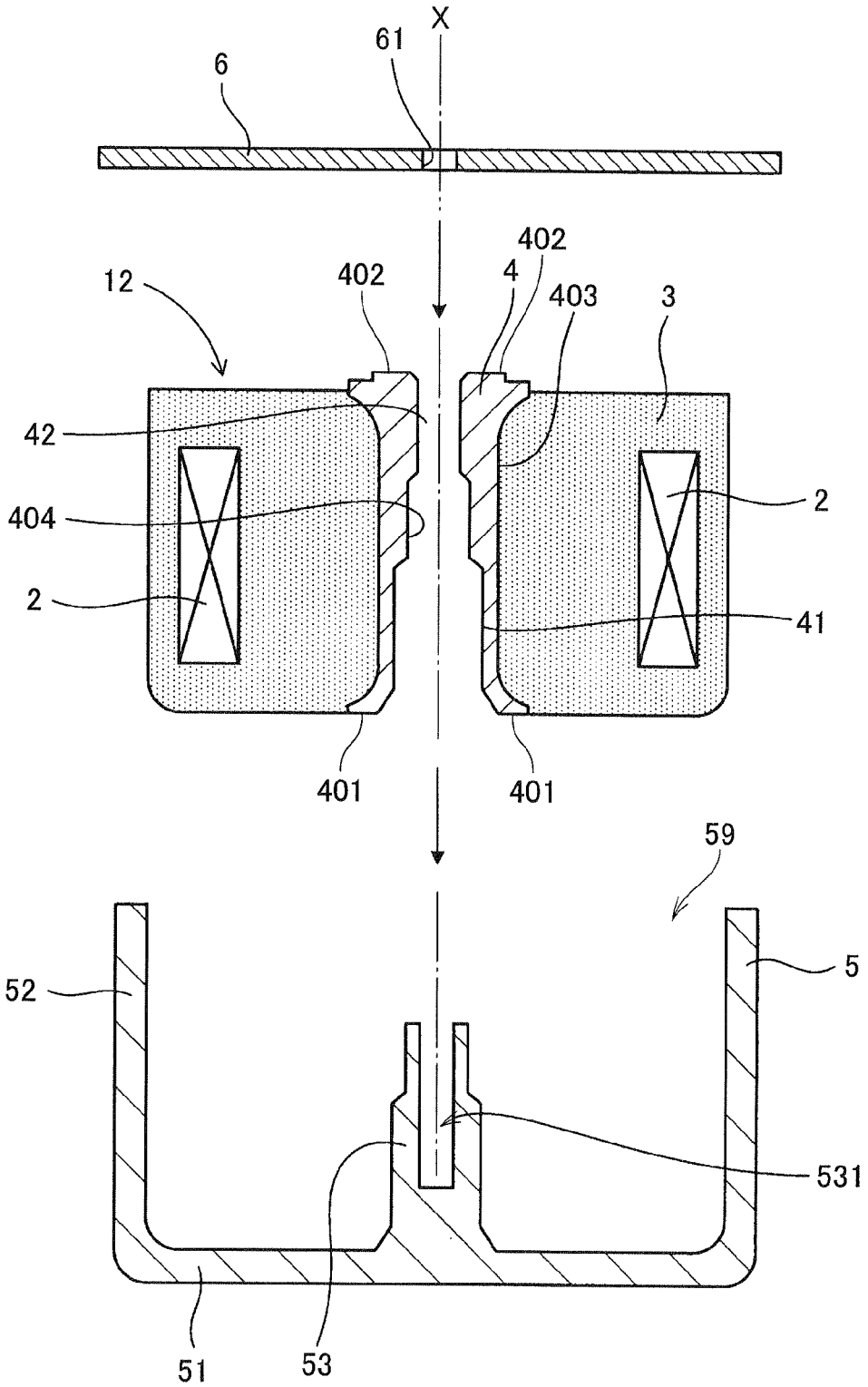
FIG. 10 shows a process where the intermediate product and lid are assembled with a case.

Next, as shown in FIG. 10, one installs the intermediate product 12 within the case 5. At this time, the center columnar member 4 is mounted onto the pillar 53 and firmly contacts with the flat surface 401 onto the bottom surface 51 of the case 5. Next, the opening portion 59 of the case 5 is closed by the lid 6. At this time, the lid 6 is contacted with the flat surface 402 of the columnar member 4.

Figure 11:
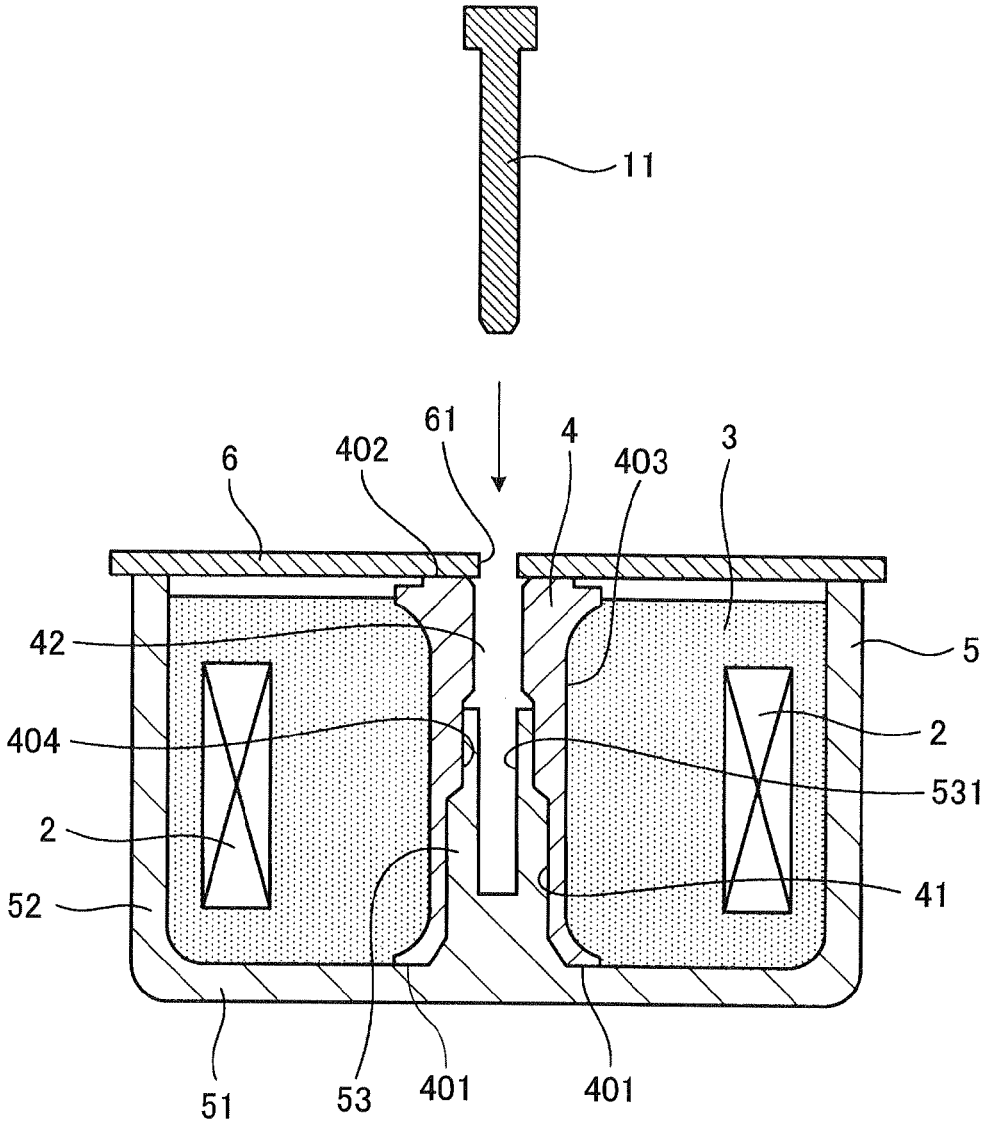
FIG. 11 shows a state where a bolt is screwed into the case.

Next, as shown FIG. 11, one fixes the lid 6, the center columnar member and the case 5 using the bolt 11. More specifically one inserts the bolt 11 into a through hole 61 of the lid 6 and next to the through hole 42 of the center columnar member 4 to mount the center columnar member 4 onto the pillar 53. And after, the bolt 11 is screwed into the inner hole 531 of the pillar 53 within the case 5. In this way, the columnar member 4 may be sandwiched and fixed by the bottom 51 of the case 5 and the lid 6 at the state where the flat surface 401 is contacted with the bottom 51 of the case 5 and another flat surface 402 is contacted with the lid 6. Thus the reactor 1 shown in FIG. 2 may be obtained.

As mentioned above, the surface roughness (Rz2) of the core contact surface 403 is larger than the surface roughness (Rz3) of the inner surface 404, i.e., basis surface, which remains as it was after die-casting. The surface roughness (Rz1) of the flat surfaces 401 and 402 that is sandwiched by housing 10 is smaller than the surface roughness (Rz3) of the inner surface 404. The effects and advantages of such exemplary reactor of the present invention will be explained below.

In the reactor of the exemplary embodiment, adhesion between the core 3 and the core contact surface 403 of the center columnar member 4 is improved by means of making the core contact surface 403 rough and making its contact area with the core 3 large. As the result, one can improve the stiffness and resonant frequency of the reactor. Therefore vibration of the reactor will be reduced while the reactor works.

Further, since adhesion between the core 3 and the core contact surface 403 of the center columnar member 4 is improved, thermal conductivity from the core 3 to the member 4 can be improved, i.e. heat radiation performance of the reactor is improved. Further one can make adhesion between the core 3 and the core contact surface 403 of the center columnar member 4 improve by means of making flat surfaces 401 and 402 smooth. Therefore one can make the center columnar member 4 firmly sandwiched using the case 5 and the lid 6.

As the result, one can greatly improve the stiffness and resonant frequency of the reactor so that the vibration of the reactor may be reduced while the reactor works. Still more, since adhesion between flat surfaces (401, 402) and housing 10 (case 5 and lid 6) is improved, thermal conductivity from the center columnar member 4 to both the case 5 and the lid 6 can be improved, i.e. heat radiation performance of the reactor is much more improved.

In afore mentioned exemplary embodiment, the housing 10 is comprised of the case 5 and the lid 6. The case 5 provides the opening portion 59 for inserting the coil 2, the core 3 and the center columnar member 4 in it. Therefore one can sandwich the center columnar member 4 using the case 5 and the lid 6 from both upper and lower direction and firmly fix them each other.

The inner surface 404 of the center columnar member 4 remains as it was after die-casting. Therefore one can easily manufacture the center columnar member 4 which provides the core contact surface 403 and flat surfaces (401, 402) by means of performing necessary processes, i.e. shot blast and machining, to necessary portions on the basis of the inner surface 404.

Since shot blasting is performed on the core contact surface 403, the surface of the core contact surface 403 becomes rough, whereby the contact area of the core contact surface 403 becomes large. In a case where the center columnar member 4 is formed by die-casting as in the afore mentioned exemplary embodiment, one can remove mold lubricant remaining on the core contact surface 403 of the center columnar member 4 by shot blasting, thereby adhesion between the core contact surface 403 and the core 3 may be much improved.

Since flat surfaces (401, 402) become smoother by machining, adhesion between flat surfaces (401, 402) and the housing 10 (the case 5 and the lid 6) may be improved. In a case where the center columnar member 4 is formed by die-casting as afore mentioned exemplary embodiment, one can remove mold lubricant remaining on flat surfaces 401 and 402 of the center columnar member 4 by machining, thereby adhesion between flat surfaces (401 and 402) and the housing 10 (the case 5 and the lid 6) may be much more improved.

Thus, according to the present invention, the reactor of which vibration can be reduced and of which radiation performance can be improved has been presented.

The present invention may be embodied in several other forms without departing from the spirit thereof. The embodiments and modifications described so far are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A reactor comprising:

a housing;

a solenoid coil;

a center columnar member, that has first surfaces which contact with sandwich portions of the housing; and a core which is composed of resin including magnetic powder, wherein the coil and the center columnar member are fixed in the core;

the center columnar member has a second surface and a basis surface, the second surface contacting with the core, a surface roughness of the second surface is larger than a surface roughness of the respective first surfaces, and a surface roughness of the basis surface is smaller than the surface roughness of the second surface and larger than the surface roughness of the respective first surfaces.

2. The reactor according to claim 1, wherein the housing is comprised of a cylindrical case and a lid an upper portion of the cylindrical case is opened, a pillar is formed at the center of a bottom of the cylindrical case along its center axis, and the lid is configured to close the opened portion of the cylindrical case, the sandwich portions of the housing are comprised of the bottom of the case and the lid, the first surfaces correspond to both an upper surface of the center columnar member which contacts with the lid and a lower surface of the center columnar member which contacts with the bottom of the case, and the basis surface corresponds to an inner surface of the center columnar member.

3. The reactor according to claim 2, wherein the first surfaces are surfaces to which machining was performed, the second surface is a surface on which shot blasting was performed and the basis surface is a casting surface formed by die-casting.

4. The reactor according to claim 3, wherein the shot blasting is performed by means of spraying of abrasive corundum.

5. The reactor according to claim 3, wherein the surface roughness of the respective first surfaces is 6.3 μm or less, and the surface roughness of the second surface is 16 μm or more.

6. The reactor according to claim 4, wherein the surface roughness of the respective first surfaces is 6.3 μm or less, and the surface roughness of the second surface is 16 μm or more.

7. The reactor according to claim 1, wherein the first surfaces are surfaces to which machining was performed, the second surface is a surface on which shot blasting was performed and the basis surface is a casting surface formed by die-casting.

8. The reactor according to claim 7, wherein the shot blasting is performed by means of spraying of abrasive corundum.

9. The reactor according to claim 8, wherein the surface roughness of the respective first surfaces is 6.3 μm or less, and the surface roughness of the second surface is 16 μm or more.

10. The reactor according to claim 1, wherein the surface roughness of the respective first surfaces is 6.3 μm or less, and the surface roughness of the second surface is 16 μm or more.

* * * * *